US006651463B2

(12) United States Patent
Bonnin

(10) Patent No.: US 6,651,463 B2
(45) Date of Patent: Nov. 25, 2003

(54) KNITTED UNDERWEAR OF THE BOXER SHORTS TYPE AND METHOD FOR MAKING SAME

(75) Inventor: Michel Andre Bonnin, Autun (FR)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/203,941

(22) PCT Filed: Feb. 14, 2001

(86) PCT No.: PCT/FR01/00422

§ 371 (c)(1),
(2), (4) Date: Dec. 12, 2002

(87) PCT Pub. No.: WO01/61093

PCT Pub. Date: Aug. 23, 2001

(65) Prior Publication Data

US 2003/0140661 A1 Jul. 31, 2003

(30) Foreign Application Priority Data

Feb. 17, 2000 (FR) ..... 00 01960

(51) Int. Cl.[7] ..... A41B 9/02

(52) U.S. Cl. ..... 66/177; 66/8

(58) Field of Search ..... 66/8, 17, 170, 66/171, 177, 175; 2/78.1, 78.2, 78.3; 450/95, 100, 104, 105

(56) References Cited

U.S. PATENT DOCUMENTS 4,043,156 A 8/1977 Pernick
5,590,548 A 1/1997 Osborne

*Primary Examiner*—Danny Worrell
(74) *Attorney, Agent, or Firm*—Ohlandt, Greeley, Ruggiero & Perle, L.L.P.

(57) ABSTRACT

This knitted boxer comprises a shorts part (3) forming two leg openings and a crotch part; the crotch part is made of a knitted part of two adjacent pieces of different tension, with a pinched piece (25) sewn onto a front seam (10) connecting the two leg openings and a non-pinched part sewn onto a rear seam connecting the two leg openings, the rear seam being longer than the front seam.

4 Claims, 2 Drawing Sheets

KNITTED UNDERWEAR OF THE BOXER SHORTS TYPE AND METHOD FOR MAKING SAME

FIELD OF THE INVENTION

The present invention concerns a knit undergarment currently sold under the name "boxer" designating short knit underpants, designed for men and women of all ages.

BACKGROUND OF THE INVENTION

The boxer is a relatively complex article since it is designed to cover both the base of the trunk and the top of the thighs over a sufficient length. It comprises shorts terminated at their upper part by a belt positioned at the waist, and at its lower part by two reverse parts positioned on the thigh separately. It is currently made starting from a knit tube corresponding to a diameter permitting covering the base of the trunk without seams, and is furnished with a sewed bottom or crotch part during assembly operation, permitting connecting the two tubes covering the legs. Knitting on circular looms such as the SANTONI [Model] SM8-8 looms is known, for diameters comprised between 10 and 16 inches (between 25 and 40 cm), for tubes designed for the manufacture of boxers with a double belt at the top and a double reverse part at the bottom, this tube being able to be knit in both directions (from belt to reverse part or reverse part to belt). Assembling the bottom of the tube to create the crotch part of the boxer is also known, with or without a bottom part made on the same type of knitting loom. One can also refer to the documents U.S. Pat. Nos. 3,937,040; 4,043,156 and 5,590,548.

A problem often encountered with this type of clothing article is the lack of comfort for the wearer, partly linked to the presence of uncomfortable seams at the level of the crotch and/or a poor conformity of this bottom part to the anatomy of the wearer, and more particularly to the presence of uncomfortable seams on the front at the level of the genital organs, particularly for men. The object of the invention is to create a profiled bottom or crotch part especially designed to give a better positioned front seam and therefore an improved comfort during wear, while obtaining a correct length on the thigh, and in a simple manner.

SUMMARY OF THE INVENTION

The object of the invention is achieved by means of a manufacturing process for the boxer comprising circular knitting of a tube, knitting a bottom or crotch part, cutting two bottom lines at the front and back of the tube, sewing of the knit bottom part to the bottom lines to form the crotch and leg holes and to assemble the boxer, characterized in that the length of the bottom or crotch seam on the front is less than the length of the bottom or crotch seam on the rear.

Advantageously, the bottom part is a profiled bottom or crotch part made up of two adjacent parts knit roughly in one piece, one part being knit in a more "pinched" manner than the other and being designed to come onto the shorter seam length, i.e., on the front, the two parts being roughly rectangular when they are knit together.

Advantageously, a secondary tube is knit independently, comprising an assembly of several two-piece bottom parts, on a circular loom identical to or different from that which served to knit the principal tube.

The invention also concerns the finished product obtained by the manufacturing process, i.e. a knit boxer comprising shorts forming two leg openings and a crotch part, characterized in that the crotch part is made from a knitted piece of two adjacent parts with different tension, with a more pinched part sewed onto a front seam joining the two leg openings and a more loosely part that is not pinched sewed on a rear seam joining the two leg openings, the rear seam being longer than the front seam.

When the boxer is pulled on, the part that is more pinched comes to be positioned in the crotch of the wearer, in the area where there is need for a lighter material. The seam made in the front comes to be positioned lower and does not cause discomfort. The bottom part rises higher in the rear which does not at all hinder comfortable walking. The legs move better with the wearer, and tight pinching and riding up is eliminated.

Thus, by means of the invention, a bottom part narrower in the front than the rear is created in one piece with the two reverse parts having only two seams following the pattern cutting lines of the principal tube, while if one proceeds in the conventional manner by sewing pieces of cut-out woven or knit fabric, one would have less esthetically attractive seams which cause more discomfort to the wearer.

BRIEF DESCRIPTION OF THE DRAWINGS

Other advantages and characteristics will appear more clearly upon reading the description which follows in reference to the attached drawings in which.

DETAILED DESCRIPTION OF THE INVENTION

Figure 1:
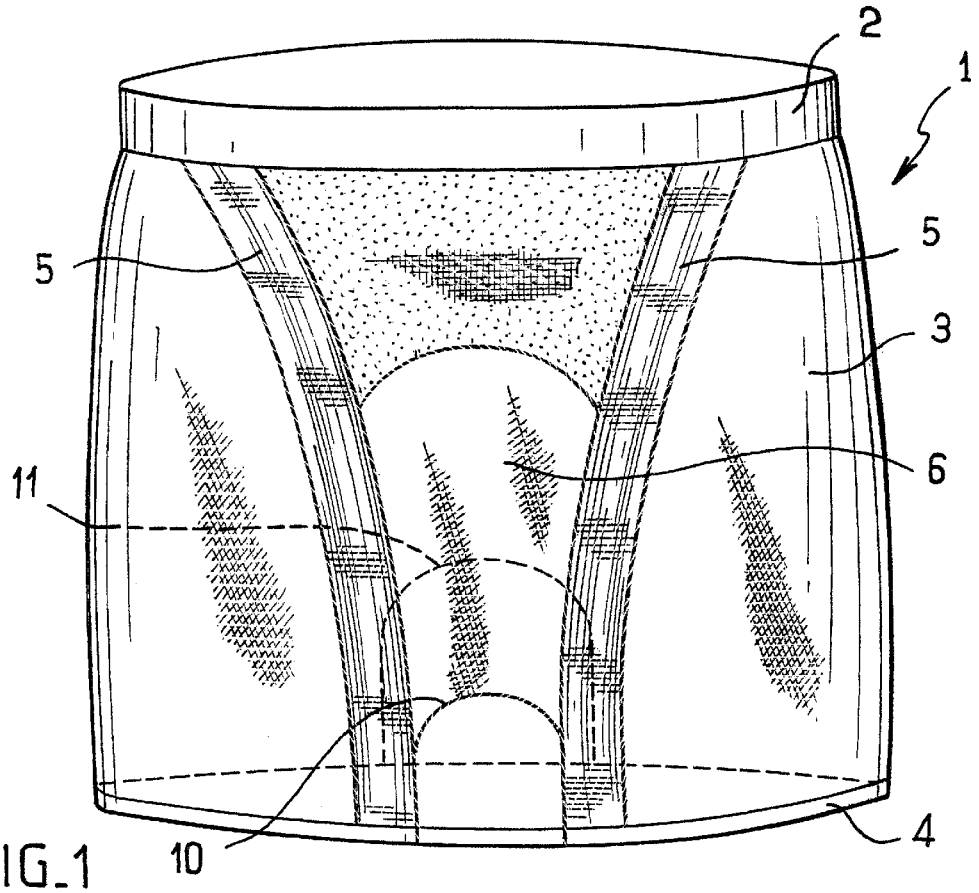
FIG. 1 is a perspective front view of the principal knit tube designed to form a boxer conforming to the invention.

FIG. 1 shows a knit tube 1, created, for example, on a Santoni SM8-8 14" (25 cm) loom, with the belt 2, the shorts part 3 and a double reverse part 4. The shorts 3 comprise in the front symmetrical designs of reinforcing strips 5 converging towards the bottom, and, between the two strips, a looser part 6 forming a pocket, increasing comfortable walking.

FIG. 1 shows the cutting lines for front 10 and rear 11 designed for assembling of the bottom part, both in the shape of a roughly circular or elliptical arc with roughly vertical straight legs. Cutting line 10, which initially partially follows the bottom of strips 5 and then roughly forms the arc of a circle, has an evolute or curved part of approximately 8.5 cm, while rear pattern 11 is roughly twice as large, with a curve of approximately 15 cm. This off-setting of the curved parts is designed to favor sliding of the bottom part towards the rear during wear, as can be seen.

Figure 2:
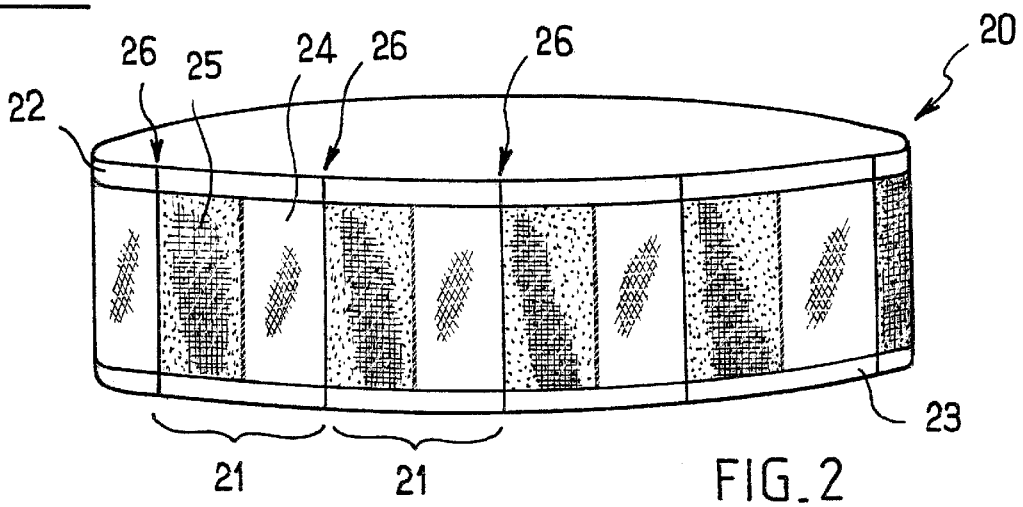
FIG. 2 is a perspective front view of the secondary tube designed to cut out the profiled bottom parts.
Figure 3:
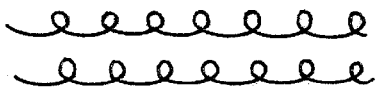
FIGS. 3 and 4 are knitting diagrams for the normal and pinched parts, respectively of a profiled bottom part of the invention.
Figure 4:
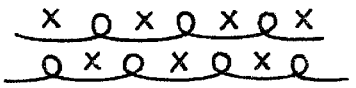

FIG. 2 shows a tube 20 knit on the same loom as principal tube 1 and comprising nine identical bottom parts 21 knit on the circumference and provided with a reverse top 22 and a reverse bottom 23 identical or similar to reverse bottom 4 of principal tube 1. Bottom parts 21 are adjacent on the periphery of tube 20 and each comprise two roughly rectangular parts on tube 20, i.e. a normal part 24, made, for example, of classical jersey stitches on all the needles as diagrammed in FIG. 3, and an adjacent pinched part 25 made, for example, by knitting one stitch on two knitting rows, as diagrammed in FIG. 4. Comparatively on the same column of stitches and for two knit rows, in normal part 24, one has two knit stitches and in the pinched part there is only one.

One begins by knitting a first reverse part 22, of the same materials and same types of stitches as reverse part 4 of the principal tube, unless one wishes to produce a different effect. After the end of double reverse part 22, the needles and jacks are selected so as to obtain the circle of bottom parts 21 comprised of normal parts 24 and pinched parts 25, that are knit over a sufficient length so that they can be mounted during the assembly operation (see below) on front cutting line 10 and rear cutting line 11. The tube is terminated by the other double reverse part 23 identical to reverse part 22.

After knitting of tube 20 of bottom parts 21, the nine bottom parts 21 are cut along cutting lines 26 separating the bottom parts 21.

Figure 5:
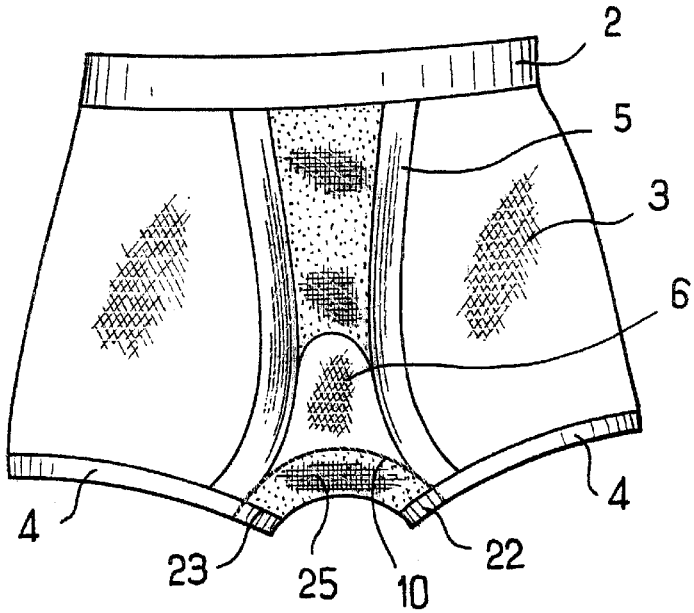
FIGS. 5, 6 and 7 are respective views of the front, the rear and the bottom of a boxer manufactured according to the invention.
Figure 6:
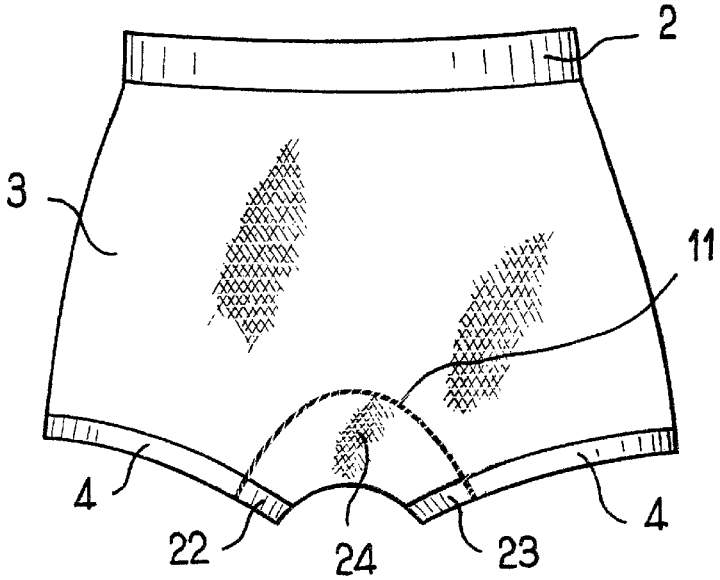
Figure 7:
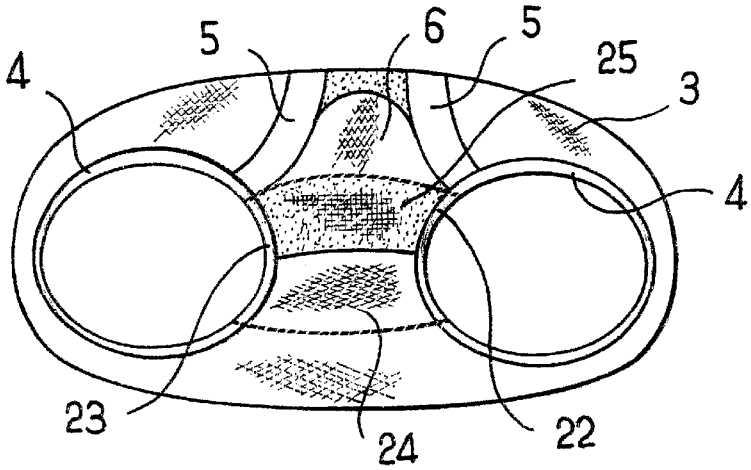

During the assembly operation (see FIGS. 5, 6 and 7), the cut edge of the pinched part 25 is sewn onto front cutting line 10 of the principal tube, while the cut edge of normal part 24 is sewn onto rear cutting line 11 which is longer than the principal tube. This is possible due to the fact that, taking into account the difference of tension between normal part 24 and pinched part 25, the cut edges of said parts do not have the same length. As a result of the assembly, reverse parts 22 and 23 are in the extension of bottom reverse part 4 of the principal tube and form with the latter the bottom reverse part of the respective right and left legs of the finished boxer.

The present invention having been thus described with particular reference to the preferred forms thereof, it will be obvious that various modifications may be made therein without departing from the spirit and scope of the present invention as defined in the appended claims.

What is claimed is:

1. A method for the manufacturing process for a pair of boxer shorts comprising:

circular knitting of a principal tube;

knitting of a bottom part;

cutting out of a front portion and a back portion of said principal tube in two bottom lines;

sewing said knitted bottom part to said bottom lines to form a crotch part and a pair of leg openings; and assembling said pair of boxer shorts such that a length of a first seam of said bottom part on said front portion is smaller than a length of a second seam of said bottom part on said rear portion, said bottom part being made of two substantially rectangular shaped adjacent parts knitted in one piece, a first bottom part being knit in a more pinched manner than a second bottom part, said bottom part being designed to be placed on said first seam of said bottom part at said front portion of said principal tube.

2. The process according to claim 1, further comprising a secondary tube for making an assembly of several bottom parts in two pieces being knit independently on a circular loom.

3. The process according to claim 2, wherein said principal tube comprises a lower reverse part and said secondary knitted tube comprises two reverse parts that are identical or similar to said lower reverse part of said principal tube.

4. A knitted pair of boxer shorts comprising:

a pair of leg openings; and a crotch part being made of a pinched part sewn onto a front seam joining said pair of leg openings and a non-pinched part sewn onto a rear seam connecting said pair of leg openings, said rear seam being longer than said front seam, said pinched part and said non-pinched part being adjacently positioned and knitted with different tensions.

* * * * *